United States Patent [19]

Asami

[11] Patent Number: 4,736,721

[45] Date of Patent: Apr. 12, 1988

[54] BOOST COMPENSATOR FOR USE WITH INTERNAL COMBUSTION ENGINE WITH SUPERCHARGER

[75] Inventor: Toshiaki Asami, Higashimatsuyama, Japan

[73] Assignee: Diesel Kiki Co., Ltd., Tokyo, Japan

[21] Appl. No.: 59,558

[22] Filed: Jun. 8, 1987

[30] Foreign Application Priority Data

Jun. 17, 1986 [JP] Japan ..... 61-141039

[51] Int. Cl.[4] ..... F02M 39/00

[52] U.S. Cl. ..... 123/383; 123/373

[58] Field of Search ..... 123/383, 382, 373, 365, 123/364, 387, 386, 385

[56] References Cited

U.S. PATENT DOCUMENTS

| | | | |
|---|---|---|---|
| 2,569,664 | 10/1951 | Gewinner | 123/382 |
| 2,758,584 | 8/1956 | Hogeman | 123/383 |
| 2,767,700 | 10/1956 | Parks | 123/383 |
| 4,015,573 | 4/1977 | Okura | 123/383 |
| 4,054,112 | 10/1977 | Kurokawa | 123/383 |
| 4,086,898 | 5/1978 | Kriz | 123/383 |

FOREIGN PATENT DOCUMENTS 60-107337 7/1985 Japan .

*Primary Examiner*—Carl Stuart Miller

*Attorney, Agent, or Firm*—Frishauf, Holtz, Goodman & Woodward

[57] ABSTRACT

A boost compensator for controlling the position of a control rack of a fuel injection pump to supply fuel to an internal combustion engine with a supercharger in response to boost pressure to be applied to the engine. The control rack is moved in a direction increasing an amount of fuel to be supplied to the engine, by angular movement of a main lever in one direction during forward movement of a push rod in response to an increase in the boost pressure from a first to a second set value. As the boost pressure reaches a third set value higher than the second set value, the push rod is brought into engagement with an auxiliary lever biased by a return spring. As the boost pressure exceeds the third set value, further forward movement of the push rod causes the auxiliary lever to angularly move against the return spring to bring an abutment member carried on the auxiliary lever into engagement with the main lever, causing the main lever to angularly move in the opposite direction to move the control rack in a direction decreasing the amount of fuel to be supplied to the engine.

7 Claims, 4 Drawing Sheets

FUEL INJECTION PUMP
ENGINE WITH SUPERCHARGER
40
30
1
1a
2
3
4
4a
5
6
7
7a
8
9
10
10a
10b
10c
11
12
13
13a
14
15
16
16a
16b
17
18
19
20
21
22

BOOST COMPENSATOR FOR USE WITH INTERNAL COMBUSTION ENGINE WITH SUPERCHARGER

BACKGROUND OF THE INVENTION

The present invention relates to a boost compensator for controlling the position of a control rack of a fuel injection pump to supply fuel to an internal combustion engine with a supercharger in response to a boost pressure to be applied to the engine, i.e., in response to an amount of intake air to be supercharged into the engine.

A boost compensator of the kind referred to above is known, for example, from Japanese Provisional Utility Model Publication (Kokai) No. 60-107337. According to the known boost compensator, as shown in FIG. 1 of the accompanying drawings, a push rod 7 is disposed for forward and rearward movement in response to a boost pressure to be applied to an internal combustion engine with a supercharger and supplied to a boost pressure chamber 3. The push rod 7 has one end thereof connected to a diaphragm 5 which is urged by a boost compensator spring 6. A main lever 10 supported for angular movement about its fixed fulcrum 11 has one end thereof engageable with an abutment 9 mounted on the push rod 7 adjacent the other end thereof. A control rack 13 interlocked with a governor of a fuel injection pump, not shown, abuts against the other end of the main lever 10 and is adapted to remain at a position where the urging force of the boost compensator spring is balanced with the urging force of a control spring, not shown, and the like associated with the governor.

With the arrangement of the conventional boost compensator described above, as shown in FIG. 2 of the accompanying drawings, as the boost pressure exceeding a first set value $P_1$ as shown in FIG. 5 is transmitted to the diaphragm 5, the push rod 7 is moved forwardly by the diaphragm 5 against the urging force of the boost compensator spring 6. This permits the main lever 10 to angularly move, so that the control rack 13 moves by a predetermined distance or a fuel supercharging stroke $M_1$ from a first position $L_1$ to a second position $L_2$ in a direction increasing the amount of fuel to be supplied to the engine, until the boost pressure reaches a predetermined value $P_2$.

In the above-described conventional boost compensator, however, the control of the position of the control rack 13 by means of the main lever 10 is merely effected with respect to the first and second set values $P_1$ and $P_2$ of the boost pressure, and the control rack 13 remains at the predetermined position $L_2$ so long as the boost pressure exceeds the second set value $P_2$. Consequently, the amount of fuel to be supplied to the engine continues to increase as the boost pressure increases due to the operation of the supercharger, ultimately leading to a possibility that a bad influence is exerted upon the engine.

Conventionally, means is provided for reducing the boost pressure by a relief valve, not shown, when the boost pressure exceeds a predetermined limit. According to this means, however, it is required to arrange a detecting mechanism for actuating the relief valve and other requisite mechanisms. Accordingly, the engine system is complicated in construction, and the cost is increased.

SUMMARY OF THE INVENTION

It is an object of the invention to provide a boost compensator which can avoid the bad influence upon the engine when the boost pressure abnormally increases, by an arrangement which is simple in construction and low in cost.

According to the invention, there is provided a boost compensator for controlling the position of a control rack of a fuel injection pump to supply fuel to an internal combustion engine with a supercharger in response to a boost pressure to be applied to the engine. The control rack is movable in a first direction increasing an amount of fuel to be supplied by the fuel injection pump to the engine and in a second direction, opposite to the first direction, decreasing the amount of fuel.

The boost compensator comprises:

a push rod disposed for forward and rearward movement in response to the boost pressure, the push rod having an abutment mounted thereon:

a main lever disposed for angular movement about a first pivot, the main lever having a first portion extending between the first pivot and one end of the main lever and a second portion extending between the first pivot and the other end of the main lever, the first portion being engageable with the abutment on the push rod and the second portion capable of being abutted against an abutment provided on the control rack, the first portion moving away from the abutment on the push rod and the second portion moving toward the abutment on the control rack when the main lever angularly moves in one direction about the first pivot, the first portion moving toward the abutment on the push rod and the second portion moving away from the abutment on the control rack when the main lever angularly moves in the opposite direction about the first pivot, the second portion being urged by the abutment on the control rack and the main lever being angularly moved thereby in the opposite direction about the first pivot during forward movement of the push rod from the time the boost pressure exceeds a first set value to the time the boost pressure reaches a second set value higher than the first set value, to permit the control rack to move in the first direction;

an auxiliary lever disposed for angular movement about a second pivot, the auxiliary lever having a first portion extending between the second pivot and one end of the auxiliary lever and a second portion extending between the second pivot and the other end of the auxiliary lever, the push rod being engageable with the second portion of the auxiliary lever;

return spring means associated with the first portion of the auxiliary lever for resiliently biasing same in one direction about the second pivot; and abutment means mounted on the second portion of the auxiliary lever and engageable with the second portion of the main lever.

As the boost pressure exceeds the second set value and reaches a third set value higher than the second set value, the push rod is brought into engagement with the second portion of the auxiliary lever, and as the boost pressure exceeds the third set value, further forward movement of the push rod causes the auxiliary lever to angularly move in the opposite direction about the second pivot against the return spring means, bringing the abutment means into engagement with the second portion of the main lever to angularly move same in the one direction about the first pivot, to thereby cause the seoond portion of the main lever to urge the abutment on the control rack to move same in the second direction.

The above and other objects, features and advantages of the invention will become apparent from the ensuing detailed description taken in conjunction with FIGS. 3 through 5 of the accompanying drawings.

DETAILED DESCRIPTION

Figure 1:
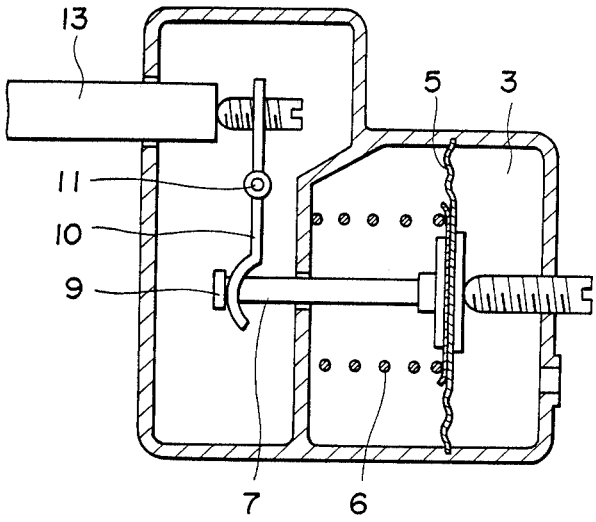
FIG. 1 PRIOR ART
FIG. 1 is a cross-sectional view showing a conventional boost compensator.
Figure 3:
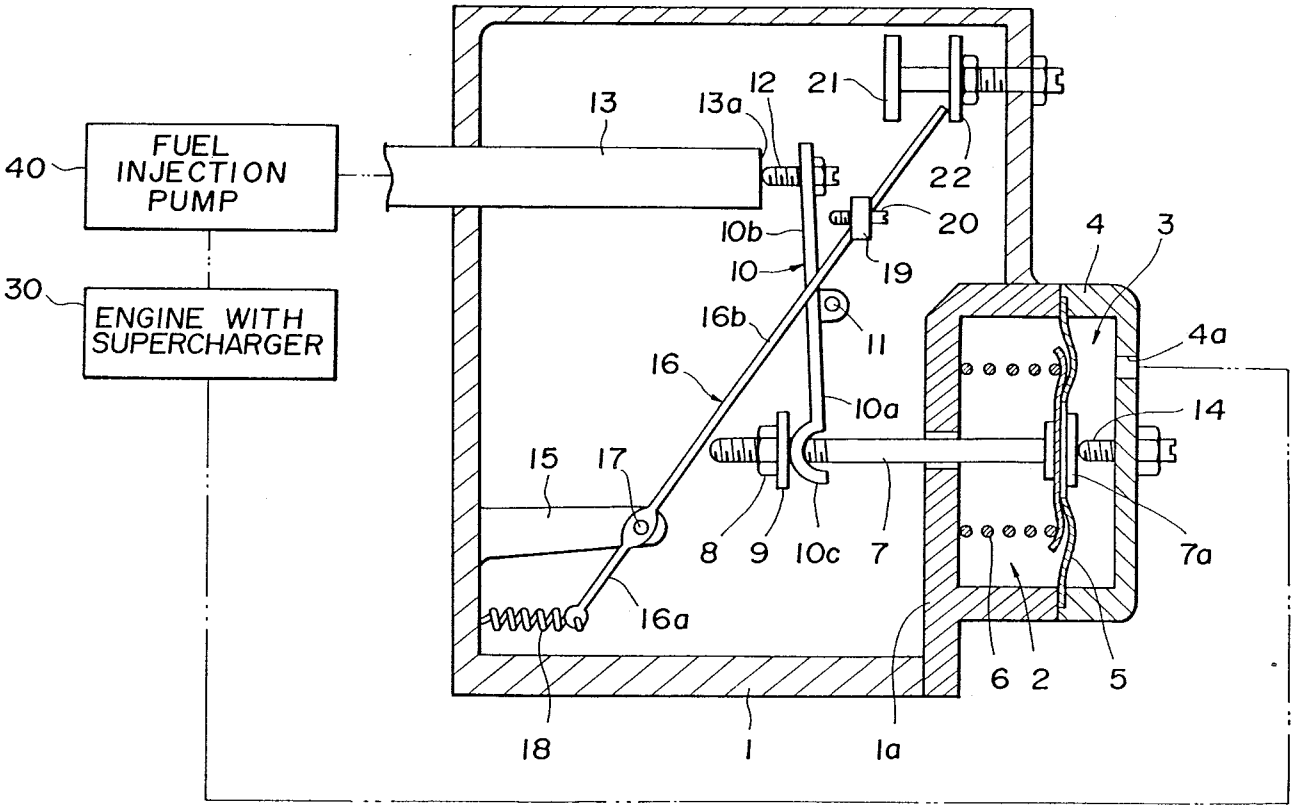
FIG. 3 is a cross-sectional view showing a boost compensator according to an embodiment of the invention.
Figure 2:
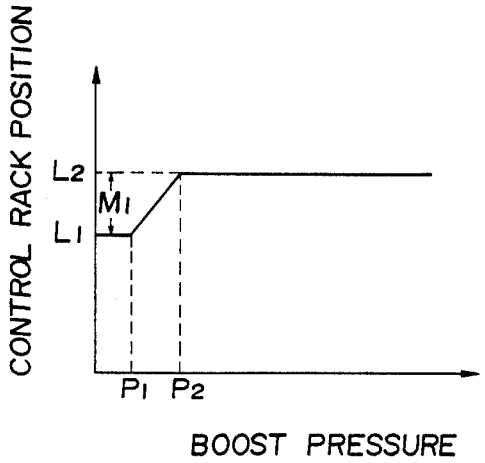
FIG. 2 PRIOR ART
FIG. 2 is a graphical representation of an operation of the conventional boost compensator.

Referring to FIG. 3 there is illustrated a boost compensator according to an embodiment of the invention, which comprises a housing 1 having a partition wall 1*a* mounted to a corner of the housing 1. A cover 4 is attached to the partition wall 1*a*, with a diaphragm 5 being clamped between the partition wall 1*a* and the cover 4. The partition wall 1*a*, the cover 4 and the diaphragm 5 cooperate with each other to define a spring chamber 2 and a boost pressure chamber 3. A boost compensator spring 6 is arranged within the spring chamber 2 to resiliently bias the diaphragm 5 toward the cover 4. The boost pressure chamber 3 communicates, through a communication bore 4*a* formed in the cover 4, with an internal combustion engine with a supercharger 30, so that a boost pressure to be applied to the engine 30 is introduced into the boost pressure chamber 3 through the communication bore 4*a*.

A push rod 7 extends through the partition wall 1*a* and is supported thereby for forward and rearward sliding movement. The push rod 7 is connected to the diaphragm 5 through a retainer 7*a* fixedly mounted on a rear end of the push rod 7. The retainer 7*a* abuts against a stopper bolt 14 threadedly engaged with the cover 4*a*, so that the retainer 7*a* is limited in its position by the stopper bolt 14. A positioning nut 8 threadedly engaged with a front end portion of the push rod 7 serves to position an abutment member 9 mounted on the push rod 7.

A main lever 10 is supported by a first pivot 11 fixedly secured to the housing 1, for angular movement about the first pivot 11. The main lever 10 has a first portion 10*a* extending between the first pivot 11 and one end of the main lever 10 and a second portion 10*b* extending between the first pivot 11 and the other end of the main lever 10. The one end of the main lever 10 is formed into a semi-circular abutment 10*c* having an outer surface thereof engageable with the abutment member 9 on the push rod 7. An abutment bolt 12 is threadedly engaged with the second portion 10*b* of the main lever 10, adjacent the other end thereof.

A control rack 13 interlocked with a governor of a fuel injection pump 40 for supplying fuel to the engine 30 extends into the housing 1 and has axial one end face 13*a* serving as an abutment against which the abutment bolt 12 abuts. The control rack 13 is axially movable to the right as viewed in FIG. 3, i.e., in a direction increasing the amount of fuel to be supplied by the fuel injection pump 40 to the engine 30 and to the left, i.e., in the opposite direction decreasing the amount of fuel to be supplied to the engine 30.

An auxiliary lever 16 is supported by a support leg 15 extending from the inner wall surface of the housing 1, through a second pivot 17 for angular movement thereabout. The auxiliary lever 16 has a first portion 16*a* extending between the second pivot 17 and one end of the auxiliary lever 16 and a second portion 16*b* extending between the second pivot 17 and the other end of the auxiliary lever 16. A return spring 18 having one end thereof secured to the inner wall surface of the housing 1 and the other end engaged with the first portion 16*a* of the auxiliary lever 16 to resiliently bias same in the clockwise direction as viewed in FIG. 3 about the second pivot 17. The front end of the push rod 7 is engageable with the second portion 16*b* of the auxiliary lever 16. An attachment 19 in the form of a nut is fixedly secured to the second portion 16*b* of the auxiliary lever 16 at a position between the free end of the second portion 16*b* and a location on the second portion 16*b* at which the front end of the push rod 7 is engageable with the second portion 16*b*. An abutment bolt 20 is threadedly engaged with the attachment 19.

A pair of spaced stoppers 21 and 22 are mounted to the wall of the housing 1, and the free end of the second portion 16*b* of the auxiliary lever 16 is movable between the stoppers 21 and 22 so that the extent of the angular movement of the auxiliary lever 16 about the second pivot 17 is limited by the stoppers 21 and 22.

Figure 4:
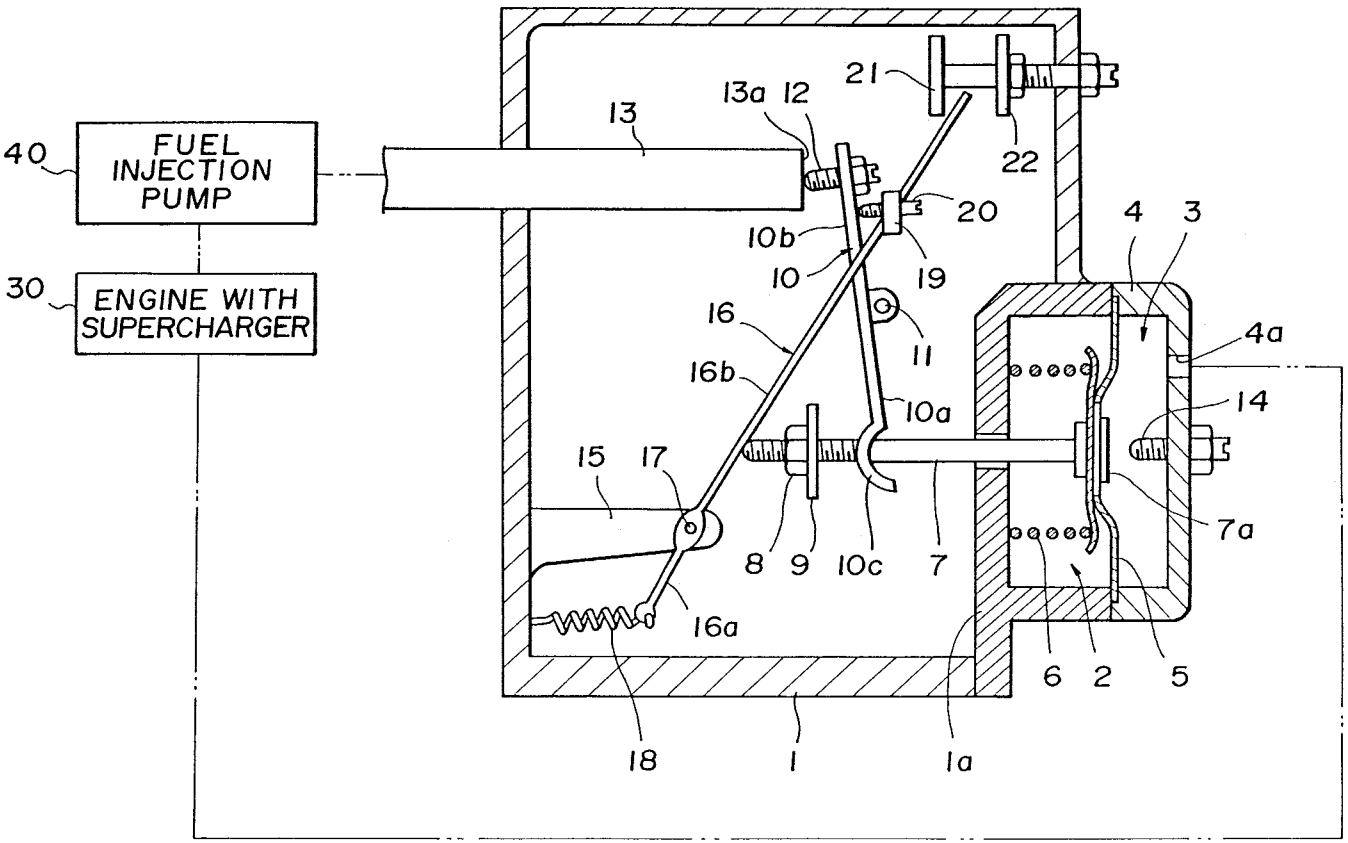
FIG. 4 is a view similar to FIG. 3, but showing a control rack which is moved in a direction decreasing an amount of fuel to be supplied by a fuel injection pump to an engine, when a boost pressure exceeds a predetermined set value.

The operation of the boost compensator constructed as described above will be described with reference to FIG. 3 as well as FIGS. 4 and 5. It is assumed here that the reference position of the control rack 13 is originally located at a first position $L_1$ in FIG. 4.

As the boost pressure to be applied to the engine 30 exceeds a first set value $P_1$, the diaphragm 5 bulges out toward the spring chamber 2 against the urging force of the boost compensator spring 6, to cause the push rod 7 to move forwardly away from the stopper bolt 14. This permits the main lever 10 to angularly move about the first pivot 11 by an extent corresponding to the distance of the forward movement of the push rod 7. In other words, the abutment 10*c* is allowed to move toward the abutment member 9 and accordingly the abutment bolt 12 is allowed to move away from the end face 13*a* of the control rack 13 by the extent corresponding to the distance of the forward movement of the push rod 7. Thus, the control rack 13 moves to the right as viewed in FIG. 3 to increase the amount of fuel to be supplied by the fuel injection pump 40 to the engine 30.

Figure 5:
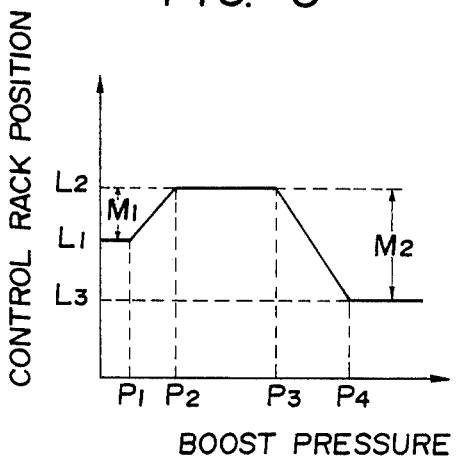
FIG. 5 is a graphical representation of an operation of the boost compensator illustrated in FIGS. 3 and 4.

As will be seen from FIG. 5, from the time the boost pressure exceeds the first set value $P_1$ to the time it reaches a second set value $P_2$ higher than the first set value $P_1$, the control rack 13 moves from the first position $L_1$ to a second position $L_2$ to secure a required fuel supercharging stroke $M_1$.

As the boost pressure exceeds the second set value $P_2$, the push rod 7 further moves forwardly into the housing 1. As the boost pressure reaches a third set value $P_3$, the front end of the push rod 7 is brought into engagement with the second portion 16*b* of the auxiliary lever 16. From the second set value $P_2$ to the third set value $P_3$, the control rack 13 remains at the second position $L_2$ as long as there is no change in the fuel supply quantity. Therefore, the abutment 10*c* of the main lever 10 remains unmoved so that the abutment member 9 on the push rod 7 moves relatively away from the abutment 10*c*, during the period from the commencement of the further forward movement of the push rod 7 in response to the boost pressure exceeding the second set value $P_2$ to the engagement of the front end of the push rod 7 with the second portion 16*b* of the auxiliary lever 16. As the boost pressure exceeds the third set value $P_3$, the auxiliary lever 16 is angularly moved by the push rod 7 against the urging force of the return spring 18 in the counterclockwise direction about the second pivot 17. This brings the abutment bolt 20 into engagement with the second portion 10*b* of the main lever 10 to angularly move same about the first pivot 11 so that the abutment 10*c* moves away from the abutment member 9 and the abutment bolt 12 is urged against the end face 13*a* of the control rack 13. Thus, the control rack 13 is moved to the left to decrease the amount of fuel to be supplied to the engine 30.

As the boost pressure reaches a fourth set value $P_4$, the angular movement of the auxiliary lever 16 is limited by the stopper 21, and the main lever 10 is prevented thereby from further moving angularly about the first pivot 11. That is, the control rack 13 moves to a third position $L_3$ and secures a moving stroke $M_2$ in the fuel decreasing direction, as shown in FIG. 3. Thus, should the boost pressure increase abnormally, the fuel would be prevented from being supercharged into the engine 30 in excess of the predetermined limit.

If the boost pressure decreases when the control rack 13 is in the third position $L_3$, the push rod 7 is moved rearwardly by the diaphragm 5 so that the auxiliary lever 16 is returned to its original position under the action of the return spring 18 and the abutment bolt 19 is disengaged from the second portion 10*b* of the main lever 10. Thus, the main lever 10 is placed into such a condition that it is not interfered with the auxiliary lever 16, making it possible to use the boost compensator like the conventional one.

What is claimed is:

1. A boost compensator for controlling the position of a control rack of a fuel injection pump to supply fuel to an internal combustion with a supercharger in response to a boost pressure to be applied to the engine, said control rack being movable in a first direction increasing an amount of fuel to be supplied by said fuel injection pump to said engine and in a second direction, opposite to said first direction, decreasing said amount of fuel, said boost compensator comprising:

a push rod disposed for forward and rearward movement in response to said boost pressure, said push rod having an abutment mounted thereon;

a main lever disposed for angular movement about a first pivot, said main lever having a first portion extending between said first pivot and one end of said main lever and a second portion extending between said first pivot and the other end of said main lever, said first portion being engageable with said abutment on said push rod and said second portion being capable of being abutted against an abutment provided on said control rack, said first portion moving away from said abutment on said push rod and said second portion moving toward said abutment on said control rack when said main lever angularly moves in one direction about said first pivot, said first portion moving toward said abutment on said push rod and said second portion moving away from said abutment on said control rack when said main lever angularly moves in the opposite direction about said first pivot, said second portion being urged by said abutment on said control rack and said main lever being angularly moved thereby in the opposite direction about said first pivot during forward movement of said push rod from the time said boost pressure exceeds a first set value to the time the boost pressure reaches a second set value higher than said first set value, to permit said control rack to move in the first direction;

an auxiliary lever disposed for angular movement about a second pivot, said auxiliary lever having a first portion extending between said second pivot and one end of said auxiliary lever and a second portion extending between said second pivot and the other end of said auxiliary lever, said push rod being engageable with said second portion of said auxiliary lever;

return spring means associated with said first portion of said auxiliary lever for resiliently biasing same in one direction about said second pivot; and abutment means mounted on said second portion of said auxiliary lever and engageable with said second portion of said main lever;

wherein as said boost pressure exceeds said second set value and reaches a third set value higher than said second set value, said push rod is brought into engagement with said second portion of said auxiliary lever, and as said boost pressure exceeds said third set value, further forward movement of said push rod causes said auxiliary lever to angularly move in the opposite direction about said second pivot against said return spring means, bringing said abutment means into engagement with said second portion of said main lever to angularly move same in said one direction about said first pivot, to thereby cause said second portion of said main lever to urge said abutment on said control rack to move same in said second direction.

2. A boost compensator as defined in claim 1, including pressure responsive means connected to one end of said push rod and movable in response to said boost pressure to move said push rod forwardly and rearwardly so that said push rod moves toward and away from said second portion of said auxiliary lever.

3. A boost compensator as defined in claim 2, wherein said pressure responsive means includes a diaphragm.

4. A boost compensator as defined in claim 1, including stopper means associated with said auxiliary lever for limiting an extent of the angular movement thereof about said second pivot.

5. A boost compensator as defined in claim 4, wherein said stopper means comprises a pair of spaced stoppers between which a free end of said second portion of said auxiliary lever is movable.

6. A boost compensator as defined in claim 1, wherein said abutment means is mounted on said auxiliary lever at a position between a free end of said second portion of said auxiliary lever and a location on said second portion of said auxiliary lever at which said push rod is brought into engagement with said second portion of said auxiliary lever.

7. A boost compensator as defined in claim 1, including a housing into which said push rod and said control rack extend, said main lever and said auxiliary lever being arranged within said housing, said first pivot being mounted to a wall of said housing, said second pivot being supported in a support leg projecting from an inner wall surface of said housing, and said return spring means having one end thereof engaged with said first portion of said main lever and the other end attached to the inner wall surface of said housing.

* * * * *